US010750808B1

(12) United States Patent
Carroll

(10) Patent No.: US 10,750,808 B1
(45) Date of Patent: Aug. 25, 2020

(54) DECORATIVE ARTIFICIAL PLANT

(71) Applicant: DESERT STEEL CORPORATION, Wichita, KS (US)

(72) Inventor: Eric Carroll, Valley Center, KS (US)

(73) Assignee: Desert Steel Corporation, Wichita, KS (US)

( * ) Notice: Subject to any disclaimer, the term of this patent is extended or adjusted under 35 U.S.C. 154(b) by 559 days.

(21) Appl. No.: 15/428,953

(22) Filed: Feb. 9, 2017

Related U.S. Application Data

(60) Provisional application No. 62/293,191, filed on Feb. 9, 2016.

(51) Int. Cl.
*A41G 1/00* (2006.01)
*A41G 1/02* (2006.01)

(52) U.S. Cl.
CPC ..... *A41G 1/02* (2013.01); *A41G 1/007* (2013.01)

(58) Field of Classification Search
CPC . A41G 1/02; A41G 1/007; A41G 1/00; A47G 33/06
See application file for complete search history.

(56) References Cited

U.S. PATENT DOCUMENTS

| | | | | |
|---|---|---|---|---|
| 1,656,310 | A | | 1/1928 | Anderson |
| 2,080,523 | A | | 5/1937 | Williams et al. |
| 2,166,002 | A | | 7/1939 | Fritsch |
| 2,186,351 | A | | 1/1940 | Stojaneck |
| 2,251,705 | A | | 8/1941 | Gonzalez |
| 3,144,375 | A | | 8/1964 | Day |
| 3,499,818 | A | * | 3/1970 | Kent |
| 3,829,349 | A | | 8/1974 | Hermanson |
| 4,727,672 | A | | 3/1988 | Hill et al. |
| 4,855,167 | A | | 8/1989 | Biehl |
| 5,085,900 | A | | 2/1992 | Hamlett |
| 5,171,615 | A | | 12/1992 | Cohen et al. |
| 5,213,855 | A | | 5/1993 | Buxton |
| 5,316,807 | A | | 5/1994 | Hill |
| 5,340,622 | A | | 8/1994 | Curitti |
| 5,611,176 | A | | 3/1997 | Juengert et al. |
| 6,122,866 | A | | 9/2000 | Thomas et al. |
| 6,247,991 | B1 | * | 6/2001 | Chen ..... A63H 33/00 40/610 |
| 6,286,266 | B1 | | 9/2001 | Popowych et al. |
| 6,343,440 | B1 | | 2/2002 | Ayers |
| 6,434,889 | B1 | | 8/2002 | Jones |
| 6,596,353 | B1 | | 7/2003 | Turner |
| 6,599,591 | B1 | | 7/2003 | Scott |
| 6,658,797 | B2 | | 12/2003 | Jones |
| 6,689,428 | B2 | | 2/2004 | Kao |
| 7,097,889 | B1 | | 8/2006 | Carroll |
| 7,118,788 | B1 | | 10/2006 | Turner et al. |

(Continued)

*Primary Examiner* — Mark Ruthkosky
*Assistant Examiner* — Julia L. Rummel
(74) *Attorney, Agent, or Firm* — Hall Estill Attorneys at Law; Mitchell McCarthy

(57) ABSTRACT

A decorative artificial plant apparatus having a tubular frame configured to resemble the longitudinal shape of trunk and branch portions of a natural plant that is being duplicated. A stack of overlapping open cylinder segments is supported on the frame shaped to collectively resemble an outer surface of the trunk portion. Each cylinder segment has an expansion feature configured to diametrically expand when overlapped around an adjacent cylinder segment in the stack.

15 Claims, 7 Drawing Sheets

(56) References Cited

U.S. PATENT DOCUMENTS

| | | | | |
|---|---|---|---|---|
| 7,144,610 | B1 | 12/2006 | Estes et al. | |
| 7,163,725 | B2 | 1/2007 | Johnson et al. | |
| D564,940 | S | 3/2008 | Carroll | |
| 7,981,490 | B1 | 7/2011 | Turner | |
| 8,309,188 | B2 | 11/2012 | Cheng et al. | |
| 8,319,091 | B2 | 11/2012 | Lyden | |
| 8,684,551 | B2 | 4/2014 | AlSaffar | |
| 8,932,689 | B2 | 1/2015 | Wei | |
| 8,936,379 | B1 | 1/2015 | Chen | |
| 2007/0087142 | A1* | 4/2007 | Irvine | B44C 5/00 428/34.1 |

* cited by examiner

DECORATIVE ARTIFICIAL PLANT

RELATED APPLICATION

This patent application claims the benefit of the earlier filing date of U.S. Patent Application No. 62/293,191.

BACKGROUND

This technology is directed to the creation of large decorative artistic works that are pleasing to those with a passion for nature and its wonderful creations. Creating a sculpture that realistically resembles nature's creation can prove to be a painstakingly long and laborious endeavor, making the final product cost-prohibitive to many who would otherwise enjoy such artwork. What is needed are improvements in the art that enable the creation of more affordable, yet beautifully elegant pieces of artwork. It is to those improvements that embodiments of this technology are directed.

SUMMARY

Some embodiments of this technology contemplate an artificial plant apparatus having a tubular frame configured to resemble the longitudinal shape of trunk and branch portions of a natural plant that is being duplicated. A stack of overlapping open cylinder segments is supported on the frame shaped to collectively resemble an outer surface of the trunk portion. Each cylinder segment has an expansion feature configured to diametrically expand when overlapped around an adjacent cylinder segment in the stack.

Some embodiments of this technology contemplate a decorative artificial *yucca* plant, having a plurality of overlapping segments defining curved and undulating protuberant features collectively resembling a *yucca* plant trunk, each overlapping segment having an expansion feature configured to diametrically expand when overlapped around an adjacent segment in the stack.

Some embodiments of this technology contemplate a method for constructing an artificial plant apparatus, including: obtaining a flat sheet having a substantially flat side, an opposing undulating side configured to resemble the surface of a plant trunk portion, and with expansion features associated with each undulation; forming the flat sheet into a ring; placing the ring onto a tubular frame configured to resemble the longitudinal shape of the trunk; and diametrically expanding the expansion features to overlap the ring around another ring in a stack of the rings.

BRIEF DESCRIPTION OF THE DRAWINGS

Details of various embodiments of the present technology are described in connection with the accompanying drawings that bear similar reference numerals.

DESCRIPTION

Initially, this disclosure is by way of example only, not by limitation. The illustrative constructions and associated methods disclosed herein are not limited to use or application for any specific system or in any specific environment. That is, the disclosed technology is not limited to usage for constructing the illustrative embodiments. Thus, although the instrumentalities described herein are for the convenience of explanation, shown and described with respect to exemplary embodiments, the skilled artisan understands that the principles herein may be applied equally in other types of structures involving the construction of a device.

Figure 1:
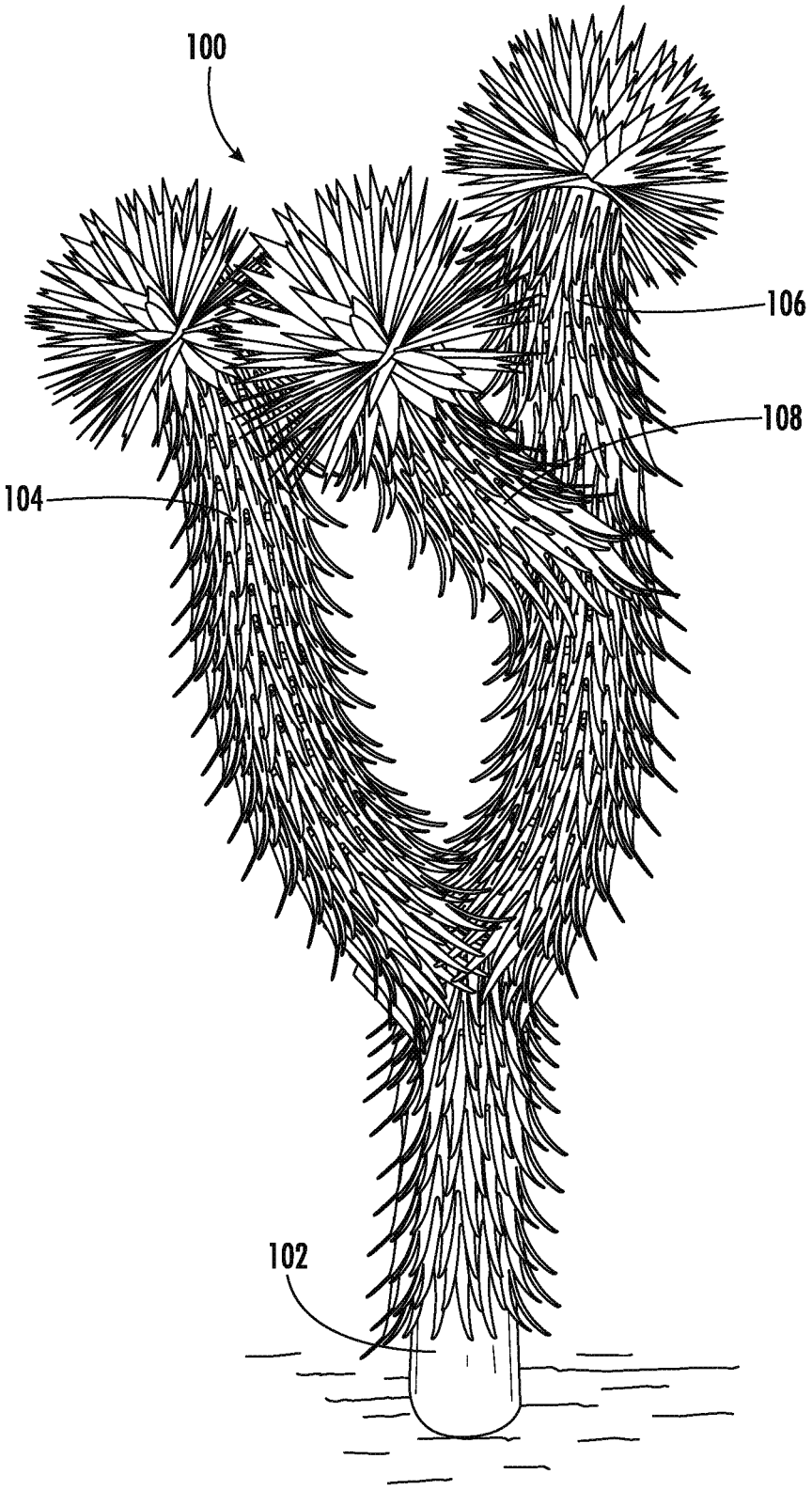
FIG. 1 depicts a decorative artificial plant that is constructed in accordance with embodiments of this technology.

FIG. 1 depicts a decorative artificial plant 100 that is constructed in accordance with embodiments of this technology. The artificial plant 100 is configured to resemble a *yucca brevifolia*, a species in the genus of *yucca* plant. Commonly referred to as a Joshua tree, *yucca* palm, and the like because of its tree-like height and branching structure, the natural plant is indigenous to arid regions of the southwest United States such as in Joshua Tree National Park and the Mohave National Preserve.

This technology readily provides an artificial resemblance of the natural phenomenon that no two *yucca* plants are shaped the same. The decorative artificial plant 100 in FIG. 1, for instance, has a main trunk 102 rising up from the ground and diverging into two branches 104, 106. A third branch 108 extends from the branch 106. Atop each branch is a spiraling-cluster of stemless evergreen bayonet-shaped leaves that taper to a needle at the distal ends. The branches 104, 106, 108 and an upper portion of the trunk 102 are covered with a tree skin that is formed of the now dead, downwardly pointing leaves that were alive atop the tree during previous growth periods.

Figure 2:
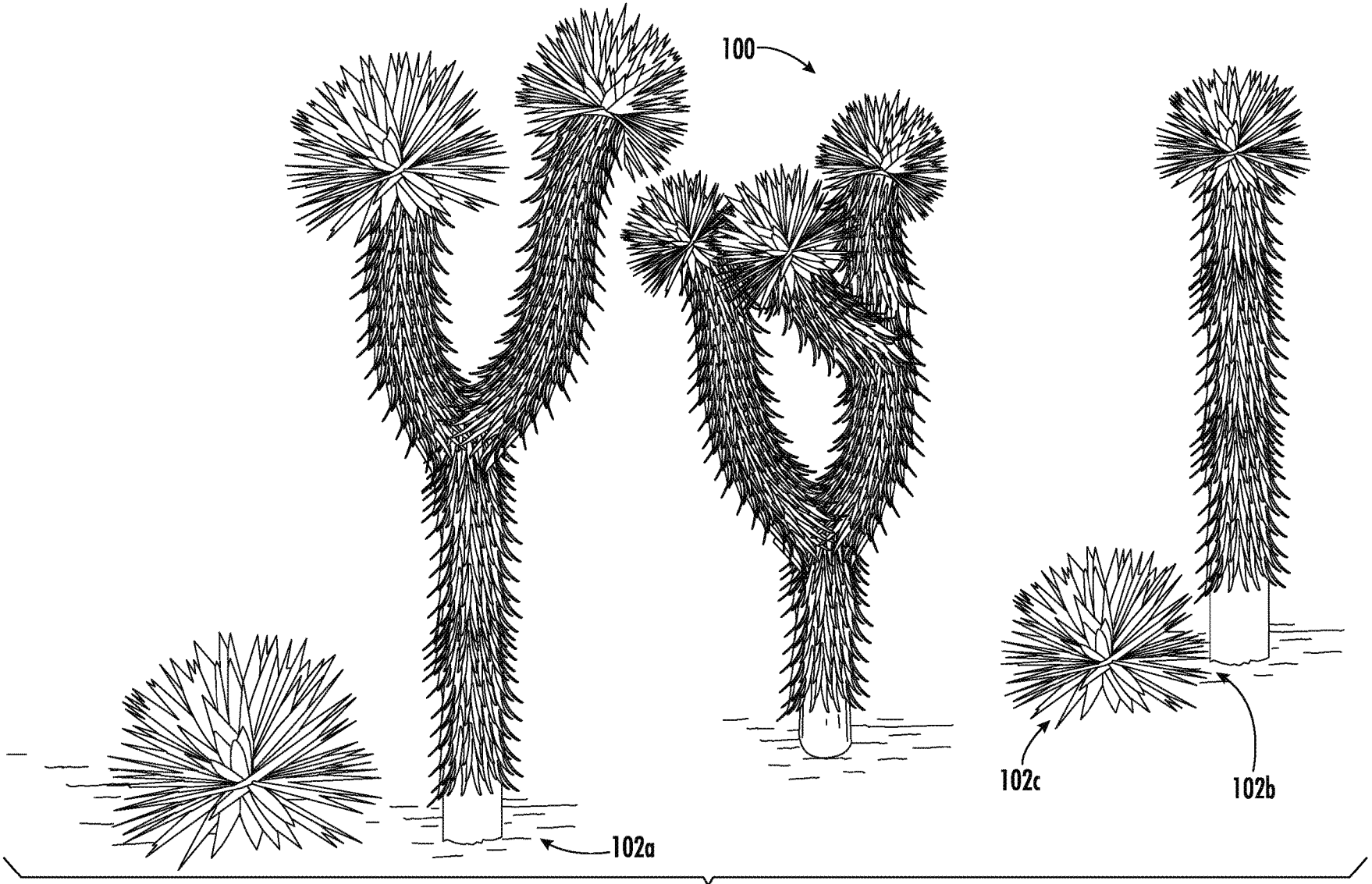
FIG. 2 depicts other decorative artificial plants that are constructed in accordance with embodiments of this technology.

In these illustrative embodiments all of the branches 104, 106, 108 are curved, although the contemplated embodiments include straight branches and even no branches. FIG. 2 depicts the decorative artificial plant 100 in comparison to other decorative artificial plants 102*a*, 102*b* that are constructed in accordance with this technology to resemble natural yuccas having two branches and no branches, respectively. The decorative artificial plant 102*c* depicts embodiments having little or no main trunk arising from the ground. Note that in nature each tree is unique, varying in the number and shape of the trunk and branches.

Figure 3:
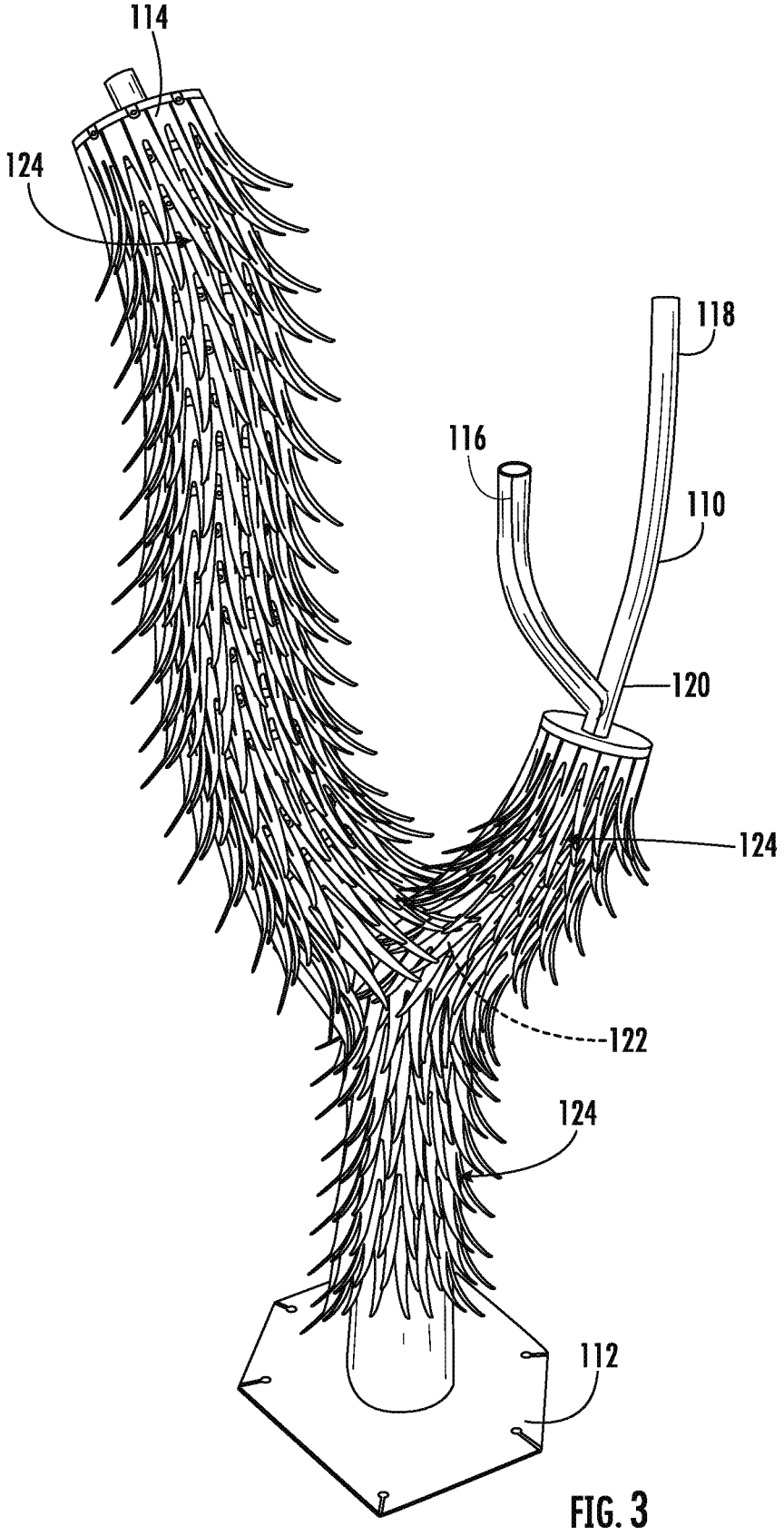
FIG. 3 depicts a partially constructed decorative artificial plant in accordance with embodiments of this technology.

FIG. 3 depicts a partially-constructed decorative artificial tree according to this technology. An upstanding tubular frame 110 is supported on a base 112 in these embodiments. Alternatively, the frame 110 can be directly attached to some supporting structure such as a concrete walkway and the like (not depicted). The frame 110 is constructed by joining tubing members together to define the overall size and shape of the decorative artificial plant. For ease of construction the individual tubes 114, 116, 118 can first be bent to resemble the curved shapes of a natural plant's trunk and branches, then the bent tubes 114, 116, 118 can be joined together at joints 120, 122 such as by welding them together. In these illustrative embodiments the frame 110 is constructed of round tubing although the contemplated embodiments are not so limited.

Figure 4:
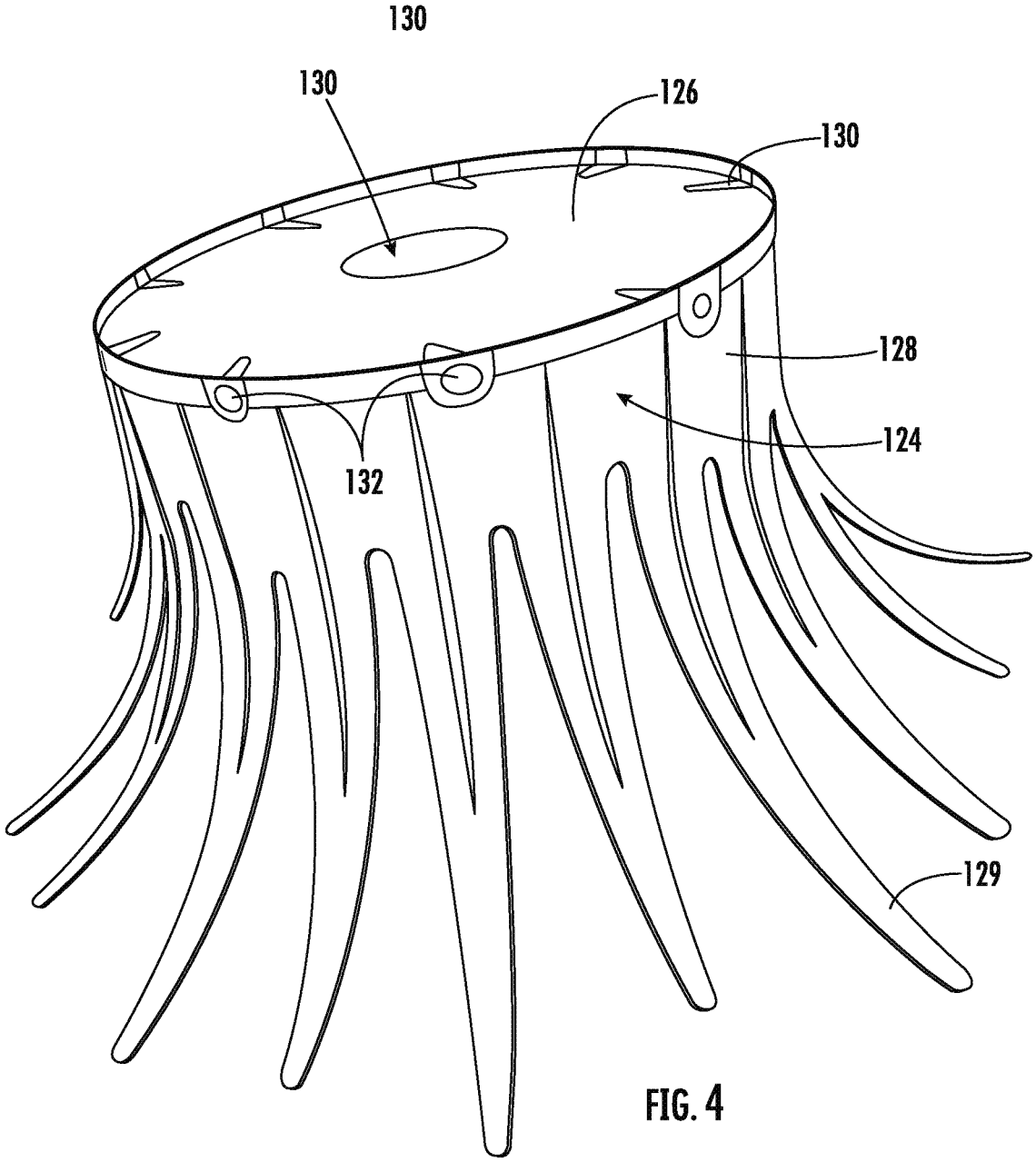
FIG. 4 is a top-side isometric depiction of a cylinder segment in the decorative artificial plant of FIG. 1.
Figure 5:
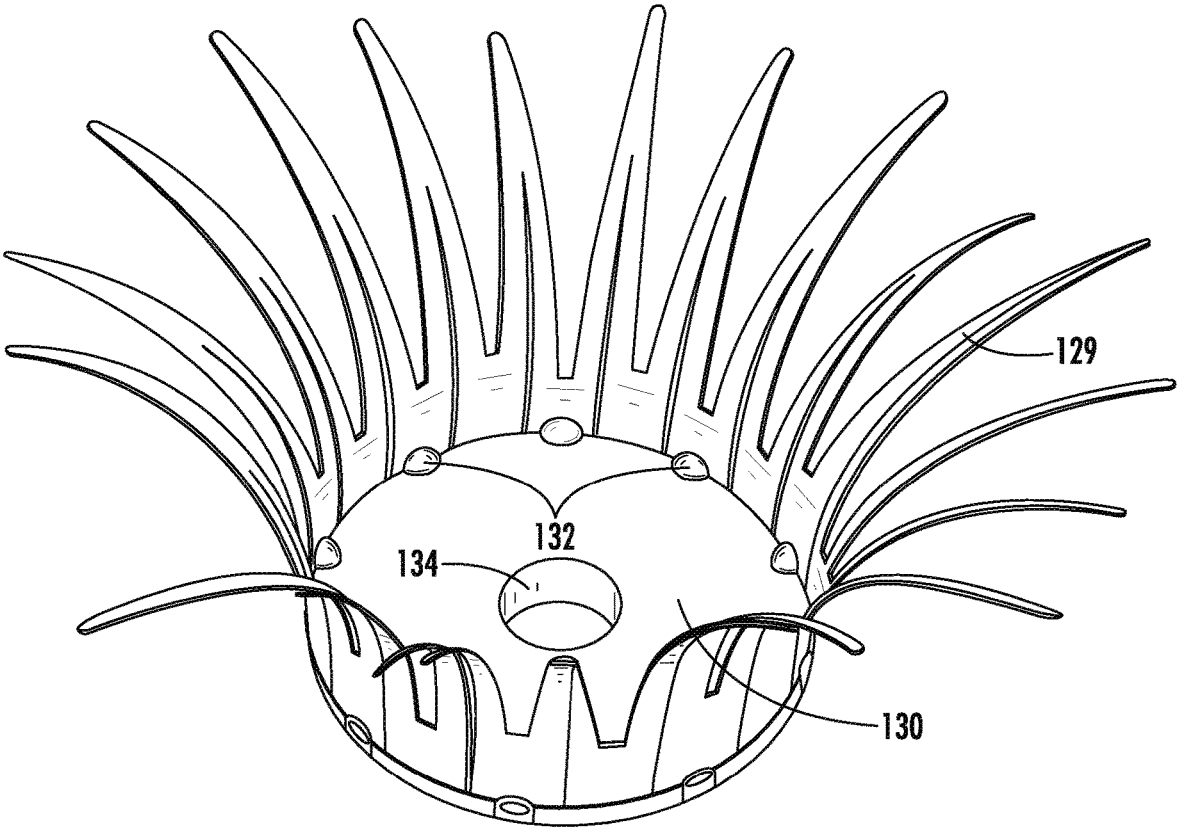
FIG. 5 is a bottom-side depiction of the cylinder segment of FIG. 4.

Stacks of overlapping open cylinder segments 124 are placed on the frame 110 to collectively resemble the outer surfaces of the trunk and branches. For purposes of this technology "open cylinder segment" means a cylindrical-shaped member that has an open end so that one open cylinder segment can be stacked onto and around another open cylinder segment. FIGS. 4 and 5 are top-side and bottom-side isometric depictions, respectively, of one of the open cylinder segments 124, having a substantially flat end 126 and an annular skirt 128 extending from the flat end 126. The skirt 128 terminates opposite the flat end at a curved and undulating edge that defines a plurality of protuberant scallops 129 that resemble the tree skin of a natural plant.

Figure 6:
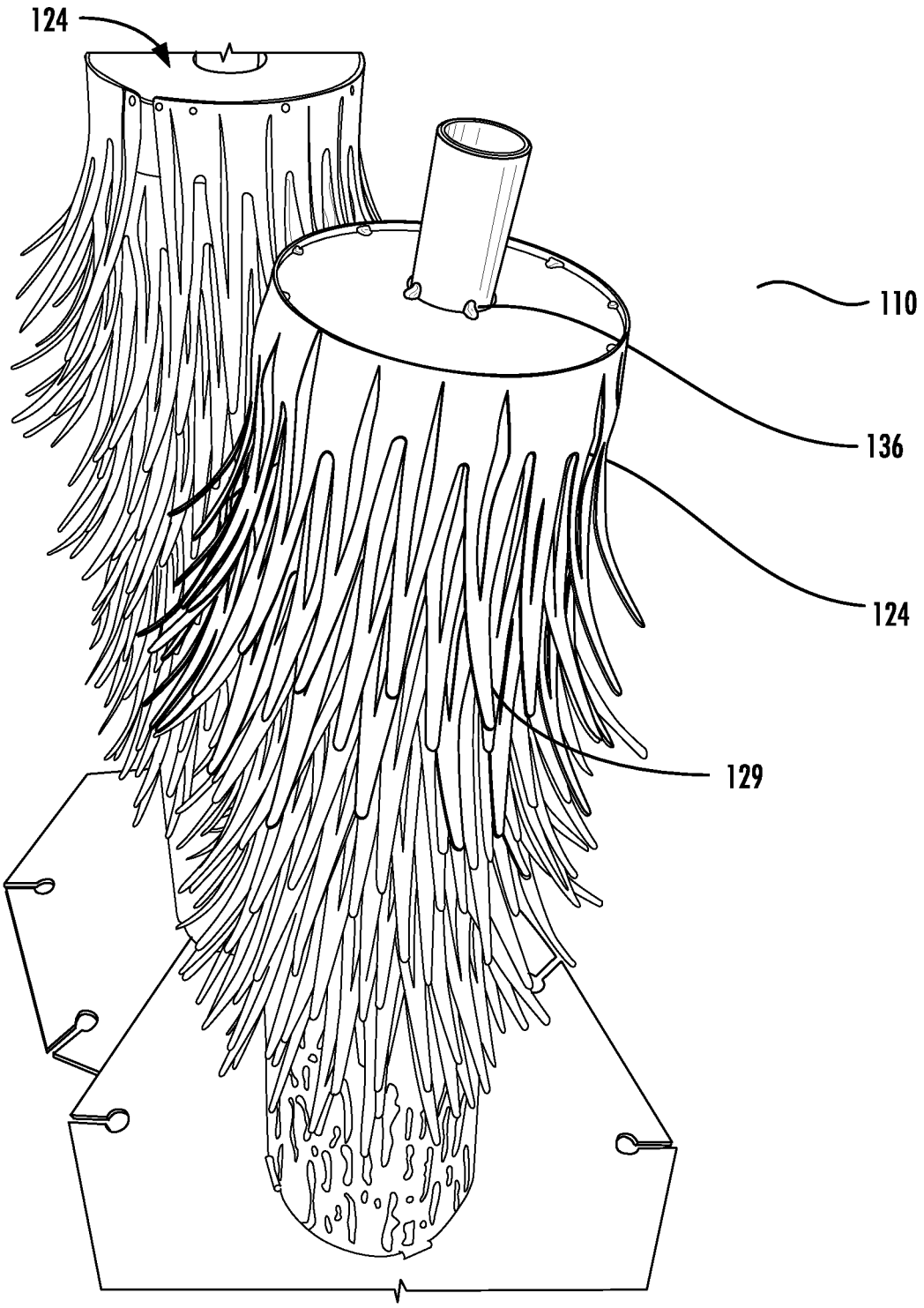
FIG. 6 depicts a cylinder segment in the background that is initially placed on the stack and another cylinder segment in the foreground that has been diametrically expanded to overlappingly surround the cylinder segment below it.

In these illustrative embodiments the skirt 128 is formed in a thin sheet of material and then formed around and attached to a central support disk 130 by a number of welds 132. The disk 130 defines an opening 134 that is sized to admit the frame 110. In the illustrative embodiments of FIG. 6 the opening 134 is sized in a close mating engagement with the outer diameter of the frame 110 suited for attaching the cylinder segment 124 to the frame 110 by a weld 136.

Returning momentarily to FIG. 3, in these illustrative embodiments at this point of construction there is a first stack of the open cylinder segments 124 on the portion of the frame 110 forming the main trunk, a second stack of the open cylinder segments 124 on the left-side branch, and a third stack of open cylinder segments 124 on the right-side branch up to the joint 120 in the frame 110. The flexible scallops 129 of those three stacks are interlaced (meaning overlapped and underlapped with each other) in the area of the joint 122 as the stacks are built up, to best resemble the natural plant surfaces.

In these embodiments the third stack of open cylinder segments 124 can be constructed before the tube 116 is connected to the tube 118 to form the joint 120, because otherwise the tube 118 interferes with placing the third stack of cylinder segments 124 in place. Alternatively, cylinder segments can be provided with a slotted opening at the flat end 126 permitting them to be placed laterally on the frame 110 rather than longitudinally. In that case the frame 110 could be completely constructed and then all of the open cylinder segments placed on the frame 110.

Figure 7:
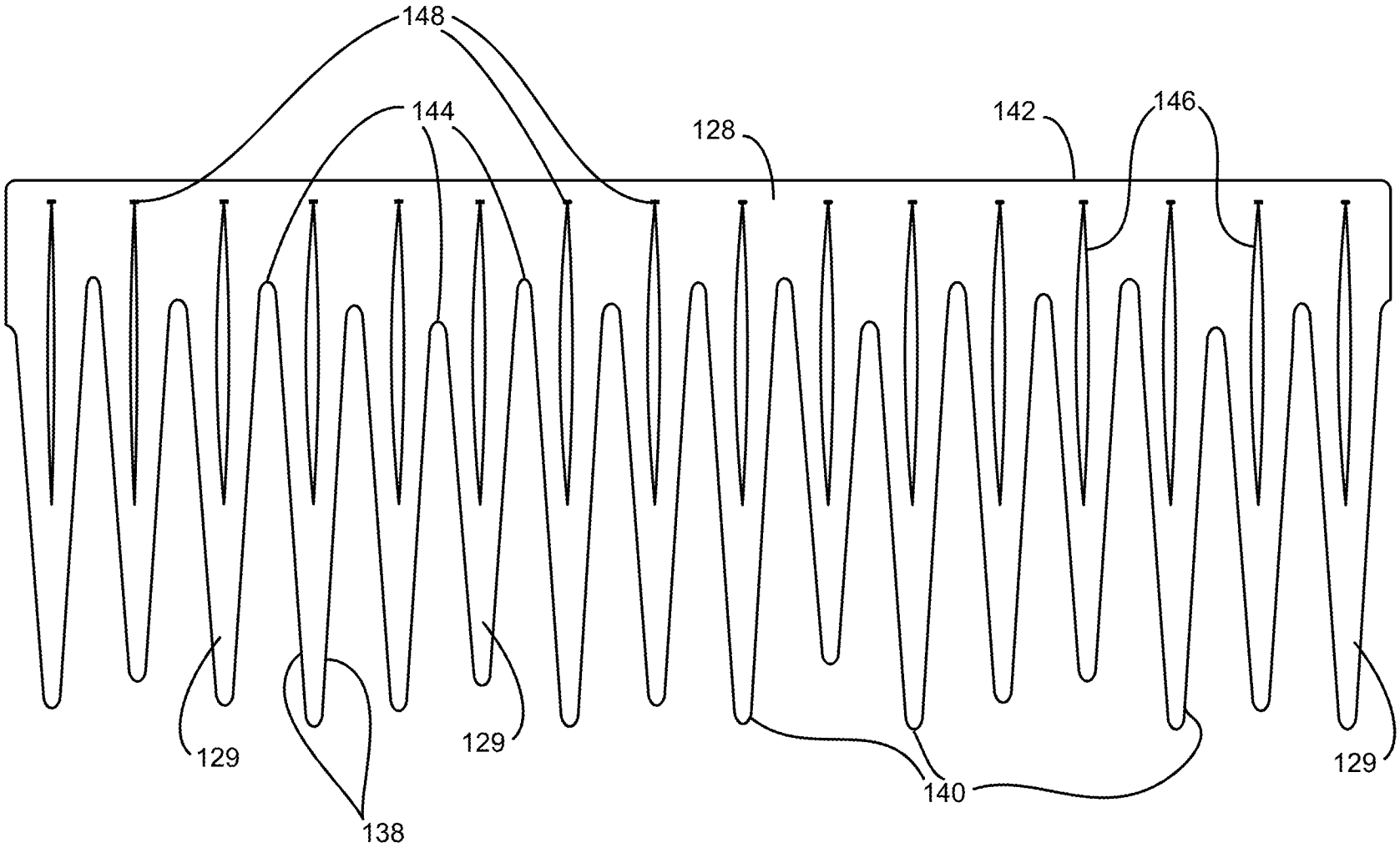
FIG. 7 depicts the skirt of the cylinder segment of FIG. 4 in the flat shape before it is formed into a cylinder shape.

FIG. 7 depicts the tree skirt 128 of these illustrative embodiments as it is formed from a thin sheet of material, such as steel. The features can be formed such as by stamping, laser cutting, waterjet cutting, and the like. In these illustrative embodiments each scallop 129 is formed to include tapered sides 138 terminating at tips 140. The skirt 128 has an upper, substantially straight edge 142 from which the tips 140 are preferably located at various different distances in order to best resemble the random lengths of different portions of the natural plant's tree skin. The skirt 128 also defines notches 144 between adjacent scallops 129 that are likewise preferably located at various random distances to best resemble the natural plant's characteristics.

The skirt 128 further defines a first expansion slot 146 on the longitudinal axis of each scallop 129, preferably varying in width and widest at a central portion thereof in this flat shape of the skirt 128 before it is formed into a cylinder. A second expansion slot 148 is substantially orthogonal to the slot 146, so as to be circumferentially-directed when the flat sheet is formed into a cylinder. In these illustrative embodiments the slots 146, 148 intersect in the flat shape of the skirt 128, although the contemplated embodiments are not so limited. Alternatively, the slots 146, 148 can be connected by tear away tabs (not depicted) that release as the cylindrical forming proceeds.

As the skirt 128 is formed into the cylinder segment 124 shape, sharp ends of the longitudinal slots 129 intensify the opposing hoop forces acting on the longitudinal axis of each scallop 129 and, consequently, urge the protuberant end of each scallop 129 into the curved shape depicted in the previously discussed FIGS. Each slot 148, being in communication with the slot 146, curls open to relieve lateral stresses that otherwise would disadvantageously urge the scallop 129 to twist.

Returning momentarily to FIG. 6 which depicts two stacks of the open cylinder segments 124. The top open cylinder segment 124 in the background stack has been placed downwardly only by the force of gravity so that only bottom portions of the outwardly-curled scallops 129 overlap the cylinder segment 124 below it. Further downward movement of the top open cylinder segment 124 is prevented by the outer diameter of the flat end of the open cylinder segment 124 below being the same size as the inner diameter of the top open cylinder segment 124. The top open cylinder segment 124 in the foreground stack has been further forced downward into the final assembled position and welded to the frame 110 to retain it in that position. The downward force on the top open cylinder segment 124 in the face of the diametric interference fit causes the upper portion of the top open cylinder segment 124 to diametrically expand (meaning the diameter of the top open cylinder segment 124 expands) so that it can be overlapped around the open cylinder segment 124 below it. The diametric expansion widens the slots 146, 148, permitting the scallops 129 to displace outwardly and downwardly to accommodate the diameter of the flat end of the open cylinder segment 124 below. This not only collectively provides the best resemblance of a natural plant surface but also advantageously interlocks the components together for robust structural integrity made possible by an elegant construction process. Push each open cylinder segment 124 down to diametrically expand it to surround the open cylinder segment 124 below, then weld it in place to the frame 110, repeat, then add the cluster of leaves at the top of the stack.

The various features and alternative details of construction of the apparatuses described herein for the practice of the present technology will readily occur to the skilled artisan in view of the foregoing discussion, and it is to be understood that even though numerous characteristics and advantages of various embodiments of the present technology have been set forth in the foregoing description, together with details of the structure and function of various embodiments of the technology, this detailed description is illustrative only, and changes may be made in detail, especially in matters of structure and arrangements of parts within the principles of the present technology to the full extent indicated by the broad general meaning of the terms in which the appended claims are expressed.

What is claimed:

1. A decorative artificial plant apparatus, comprising:

a tubular frame extending from a base and configured to resemble the longitudinal shape of trunk and branch portions of a natural plant; and a stack of overlapping open cylinder segments along the frame shaped to collectively resemble an outer surface of the trunk portion, each cylinder segment having a skirt defining an upper edge and an opposed lower edge and having a longitudinal axis extending between the upper edge and the lower edge, and the skirt further defining expansion slots between the upper edge and the lower edge such that the skirt diametrically expands its corresponding open cylinder segment in the stack when it is overlapped around an adjacent one of the open cylinder segments in the stack;

wherein each upper edge defines a substantially flat end having a substantially rigid support member situated substantially perpendicular to the longitudinal axis of the skirt that defines an opening sized to admit the tubular frame in close mating engagement thereby connecting the support member to the tubular frame, and wherein each lower edge defines a plurality of protuberant scallops.

2. The apparatus of claim 1 wherein the tubular frame comprises round tubing.

3. The apparatus of claim 1 wherein the tubular frame comprises a first tube extending from the base and a second tube extending from the first tube.

4. The apparatus of claim 3 wherein the tubes are welded together.

5. The apparatus of claim 3 comprising a first stack of the overlapping open cylinder segments on the first tube and a second stack of the overlapping open cylinder segments on the second tube.

6. The apparatus of claim 5 wherein the scallops in the first stack are interlaced with the scallops in the second stack where the tubes are connected.

7. The apparatus of claim 1 wherein the scallops have tapered sides.

8. The apparatus of claim 1 wherein the scallops terminate at respective tips located at different distances from the flat end.

9. The apparatus of claim 1 wherein the skirt defines a notch between adjacent scallops.

10. The apparatus of claim 9 wherein the notches are located different distances from the flat end.

11. The apparatus of claim 1 wherein the support member is welded to the tubular frame.

12. The apparatus of claim 1 wherein the expansion slot has a first portion extending longitudinally to the open cylinder segment.

13. The apparatus of claim 12 wherein the expansion slot has a second portion extending circumferentially to the open cylinder segment.

14. The apparatus of claim 13 wherein the first and second portions of the slot intersect.

15. A method for constructing a decorative artificial plant apparatus, comprising:

making a plurality of open cylinder segments, each open cylinder segment made by obtaining a flat sheet having a substantially flat upper edge, an opposing lower edge defining a plurality of protuberant scallops, and expansion slots between the upper edge and the lower edge, and forming the flat sheet into an open cylinder segment, each open cylinder segment having a skirt with a longitudinal axis extending between the upper edge and the lower edge; and overlapping the plurality of the open cylinder segments along a tubular frame extending from a base and configured to resemble the longitudinal shape of a trunk or a branch, wherein each upper edge defines a substantially flat end having a substantially rigid support member situated substantially perpendicular to the longitudinal axis of the skirt that defines an opening sized to admit the tubular frame in close mating engagement thereby connecting the support member to the tubular frame, and wherein the skirt diametrically expands its corresponding open cylinder segment in the stack when it is overlapped around an adjacent one of the open cylinder segments in the stack.

* * * * *